United States Patent [19]

Zelazo et al.

[11] 4,257,026

[45] Mar. 17, 1981

[54] ADJUSTABLE LINEARITY COIL ASSEMBLY

[75] Inventors: Ted S. Zelazo, Chicago; Thomas J. Wright, Itasca, both of Ill.

[73] Assignee: Bel-Tronics Corporation, Addison, Ill.

[21] Appl. No.: 82,636

[22] Filed: Oct. 9, 1979

[51] Int. Cl.[3] ..... H01F 21/06

[52] U.S. Cl. ..... 336/90; 336/110

[58] Field of Search ..... 336/110, 132, 134, 135, 336/90, 192; 323/92

[56] References Cited

U.S. PATENT DOCUMENTS

| | | | |
|---|---|---|---|
| 2,854,607 | 9/1958 | Niklas et al. | 336/110 X |
| 3,020,503 | 2/1962 | Reijnst | 336/110 |
| 3,157,848 | 11/1964 | Boiten | 336/110 |
| 3,701,067 | 10/1972 | Tsubakihana | 336/110 X |

*Primary Examiner*—Thomas J. Kozma

*Attorney, Agent, or Firm*—Leo J. Aubel

[57] ABSTRACT

An adjustable linearity coil assembly for use such as with a cathode ray picture tube. The coil is adjustable for providing correction for non-linearity of the display on the picture tube.

3 Claims, 7 Drawing Figures

ADJUSTABLE LINEARITY COIL ASSEMBLY

BACKGROUND OF THE INVENTION

A typical cathode ray picture tube includes a source of electron beams which scan a face plate or screen. As is known, if the scan lines traverse the screen at constant speed, the display on the picture tube will not be linear since as the electron beams scans the screen, it is working across an arc of a circle. Hence the scan will be traveling for a shorter distance across the center of the screen as compared to either edge of the tube or screen. Accordingly, if the beam is traveling at one rate of speed across the screen, there will be a non-linear display.

While the linearity of display is of some interest with respect to regular television picture tubes, it is difficult to see any or to discern any differences if the scan is not exactly as desired. However, the linearity of the display is more critical for computer terminals such as where typewritten pages are displayed on the face of the picture tube and if the type on one edge of the screen is smaller than the type on the other edge of the screen, it will be readily apparent and undesirable.

In addition, component tolerance (deflection yoke, horizontal output transformer, transistors, tubes, etc) will cause additional variations on the sides of the screen.

SUMMARY OF THE INVENTION

The present invention discloses a tuning coil having a dynamic adjustment. The dynamic adjustable tuning coil of the invention is connected in series with the deflection yoke in the circuit.

The foregoing features and advantages of the present invention will be apparent from the following more particular description of the invention. The accompanying drawings listed hereinbelow are useful in explaining the invention wherein:

DESCRIPTION OF THE INVENTION

Figure 1:
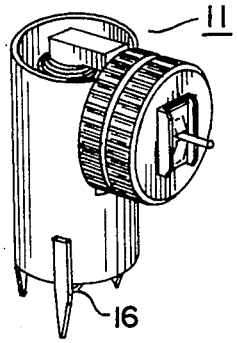
FIG. 1 is an isometric view of an adjustable tuning coil in accordance with the invention.
Figure 5:
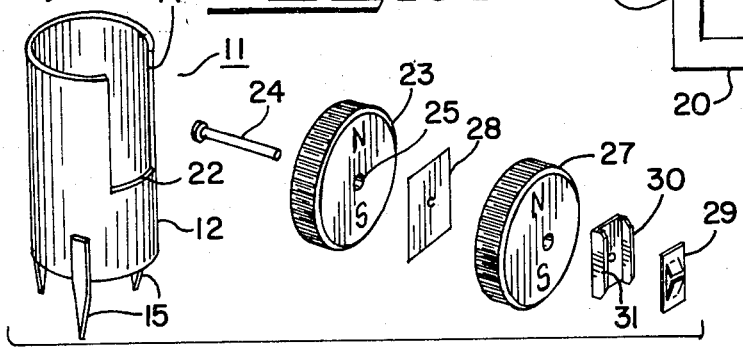
FIG. 5 is an exploded view of the structure of FIG. 1.

FIG. 1 shows an isometric view of one embodiment of the inventive adjustable coil assembly 11 substantially in actual size. The coil 11 is structurally ready for mounting on an associated electronic circuitry (board). Refer also to FIG. 5 which shows an exploded view of the coil assembly of FIG. 1 to more clearly show the structural details of the inventive assembly.

The coil assembly 11 includes a cylindrical shell 12 made such as of resin impregnated paper tubing. The shell 12 has an open elongated slot 14 formed on one end thereof. The lower part of the shell 12 has terminal pins 15 affixed thereto which may be clamped or otherwise affixed to the shell. Two of terminal pins 15 are connected to wires 16 which attach to, or form the ends of, a coil winding 17. The terminal pins 15 provide the electrical connection from the coil assembly 11 to the associated electronic circuitry, not shown.

The coil winding 17 is formed on a C-shaped core 18 having a pair of spaced, parallel oriented arms 19 and 20 extending from a center body member 21.

As shown in FIG. 1, the core 18 is inserted in position in substantial axial alignment within the cylindrical shell 12 with its arms 19 and 20 extending outwardly. The lower edge of the arm 20 is affixed adjacent to the bottom edge of slot 14. The upper arm 19 of the core 18 is substantially flush with the upper edge of the shell 12. The core 18 is affixed in position to shell 12 by gluing the ends of the arms 19 and 20 to the shell 12, and to a permanent magnet 23.

The permanent magnet 23 which is of circular configuration is affixed to the ends of the arms 19 and 20, and also to the shell 12. A rod or shaft 24 extends through a central aperture 25 formed on the magnet 23. An adjustable magnet 27, also of circular shape is mounted on the shaft 24 with magnet 27 being adjacent to the fixed magnet 23. Magnet 27 is retained on shaft 24 by a spring bracket 29 which clamps onto the rod 24, as is well known. A washer 28 comprising a plastic sheet material, is placed under the head of the shaft to reduce wear due to the abrasive nature of the powdered metal magnet 23. A channel shape washer 30 is inserted on rod 24 between the bracket 29 and magnet 27. Washer 30 includes upstanding flanges 31 which permit a tool to easily grasp the sides of the washer to rotate magnet 27 relative to the fixed magnet 23.

Figure 2:
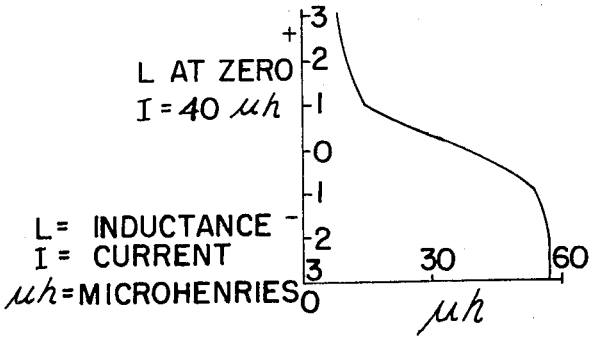
FIGS. 2, 3 and 4 are graphs useful in explaining the operation of the invention.
Figure 3:
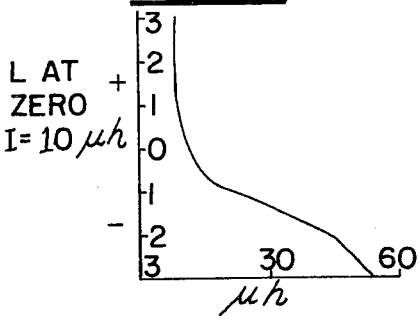

FIGS. 2 and 3 are graphs showing a curve of the yoke current relative to the inductance necessary to obtain non-linear operation to in turn provide a linear display on the cathode ray tube. In FIG. 2, the axis of ordinates or vertical axis is labeled inductance at zero current equal forty microhenries and the axis of abscissas or horizontal axis is labeled in microhenries. In FIG. 3, the vertical axis is labeled inductance at zero current equal ten microhenries and the horizontal axis is labeled in microhenries.

Figure 4:
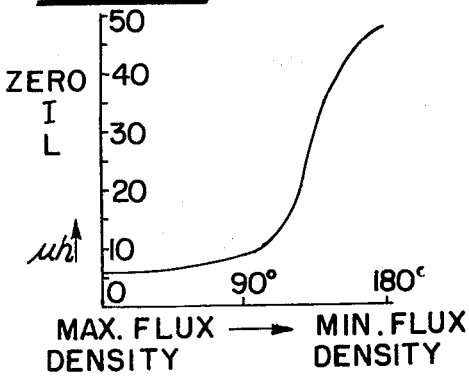
Figure 4:
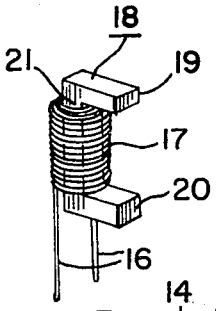
Figure 4:
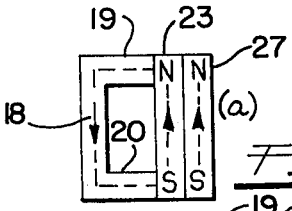

FIG. 4 is a graph showing the current relative to inductance variation due to the rotation of the magnet 27. The vertical axis indicates zero current inductance and the horizontal axis indicates the range from maximum to minimum flux density as the magnet is rotated from zero through 180 degrees.

An important feature of the present invention is that the desired inductance variation in the coil 17 is obtained by adjusting the D.C. flux provided by the magnets 23 and 27 to the saturable core 18. Since the permeability of core 18 depends upon the amount of steady magnet flux to which the core is subjected, an adjustment of permeability of the core changes the inductance of the coil.

Figure 6:
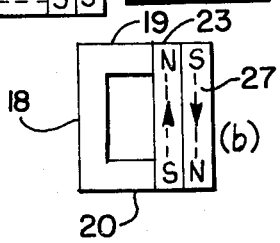
FIGS. 6(*a*) and 6(*b*) are sketches useful in explaining the structure of the invention.

As is shown in FIGS. 6(*a*) and 6(*b*), when the magnetic poles of magnet 27 are rotated to be aligned or correspond to the magnetic poles of magnet 23, the magnetic lines of force extend through core 18 and hence the permeability of the core 18 may be said to be at a minimum level. When the magnet 27 is rotated such that its magnetic poles are in position as depicted in FIG. 6(*b*), the lines of force tend to complete the magnetic loop within the magnets 23 and 27 and hence the permeability of core 18 may be said to be at a maximum level. By adjusting the magnet 27 to other positions within the extreme ranges depicted in FIGS. 6(*a*) and 6(*b*), other levels of magnetic permeability of the core are established.

In essence, the total reluctance of the magnetic circuit extending through the core is adjustable dependent on the steady control flux directed or shunted therethrough by the relative positioning of magnet 27 relative to magnet 23.

While the invention has been particularly shown and described with reference to a preferred embodiment thereof, it will be understood by those skilled in the art, that various changes in form and details may be made therein without departing from the spirit and scope of the invention.

We claim:

1. An adjustable linearity coil assembly for use such as with a cathode ray picture tube comprising, in combination, an essentially C-shaped core, a coil wound on said core, a first permanent magnet stationarily mounted on the free ends of said C-shaped core, a second permanent magnet, a nonmagnetizable casing, terminal pins mounted on the casing, at least two of said pins being connected with said coil for providing electrical connection means to asociated electronic circuitry, said casing including an elongated opening therein, and said core being positioned in said casing and having the free ends of the C-shape core extending outwardly through said opening, said first permanent magnet being affixed to said casing and to the free ends of said core, and a mounting shaft for mounting said second magnet in rotatable relation to said first magnet, whereby rotation of said second magnet varies the permeability of said core to thereby provide an adjustable linearity coil.

2. An assembly as in claim 1 wherein a spring bracket is mounted on said shaft for retaining said rotatable magnet thereon.

3. An assembly as in claim 2 further including a washer mounted intermediate said rotatable magnet and said bracket, and said washer having upstanding channels formed thereon to provide a surface for engagement such as by a tool whereby the rotatable magnet may be easily manipulated.

* * * * *